US008025481B2

(12) United States Patent
Foxworth

(10) Patent No.: US 8,025,481 B2
(45) Date of Patent: Sep. 27, 2011

(54) KIT FOR DECORATING CEILING FAN BLADES

(76) Inventor: Amy M. Rodgers Foxworth, N. Myrtle Beach, SC (US)

( * ) Notice: Subject to any disclaimer, the term of this patent is extended or adjusted under 35 U.S.C. 154(b) by 913 days.

(21) Appl. No.: 12/011,594

(22) Filed: Jan. 28, 2008

(65) Prior Publication Data

US 2009/0041581 A1 Feb. 12, 2009

Related U.S. Application Data

(60) Provisional application No. 60/963,825, filed on Aug. 7, 2007.

(51) Int. Cl.
*F04D 29/70* (2006.01)

(52) U.S. Cl. ..... 416/62

(58) Field of Classification Search ..... 416/62
See application file for complete search history.

(56) References Cited

U.S. PATENT DOCUMENTS

| | | | | |
|---|---|---|---|---|
| 4,832,572 | A | 5/1989 | Prucha et al. | |
| 5,281,093 | A | 1/1994 | Sedlak et al. | |
| 5,470,205 | A * | 11/1995 | Conklin, Jr. | 416/62 |
| 5,516,264 | A * | 5/1996 | Anetrini | 416/62 |
| 5,564,900 | A | 10/1996 | McAuley | |
| 5,591,005 | A | 1/1997 | McCready | |
| 5,591,006 | A | 1/1997 | DeMeo et al. | |
| 5,947,686 | A * | 9/1999 | Keyes | 416/62 |
| 6,015,261 | A | 1/2000 | Barone | |
| 6,079,947 | A | 6/2000 | Gabriel et al. | |
| 6,082,868 | A | 7/2000 | Carpenter | |
| 6,619,920 | B1 | 9/2003 | Cannon | |
| 6,857,852 | B1 * | 2/2005 | Carfagna et al. | 416/62 |
| 6,971,854 | B2 | 12/2005 | Krakowski | |
| 7,011,499 | B2 * | 3/2006 | Tomlin et al. | 416/62 |
| 7,056,090 | B1 | 6/2006 | Stengel | |
| 2001/0046440 | A1 * | 11/2001 | Nodd et al. | 416/5 |
| 2002/0084011 | A1 * | 7/2002 | Rochon | 150/165 |
| 2004/0141848 | A1 * | 7/2004 | Beaven | 416/247 R |
| 2008/0310959 | A1 * | 12/2008 | Johnson | 416/62 |

* cited by examiner

*Primary Examiner* — Richard Edgar
(74) *Attorney, Agent, or Firm* — P Jeff Martin; The Law Firm of P. Jeffrey Martin, LLC

(57) ABSTRACT

A kit for decorating ceiling fan blades is provided. The kit includes a plurality of fan blade covers adapted to readily conform to the shape of a ceiling fan blade. The covers are embellished with interchangeable decorative images or themes selectable by user.

8 Claims, 5 Drawing Sheets

KIT FOR DECORATING CEILING FAN BLADES

RELATED APPLICATIONS

This application claims the benefit of U.S. Provisional Application No. 60/963,825 filed on Aug. 7, 2007.

BACKGROUND OF THE INVENTION

1. Field of the Invention

The present invention relates generally to ceiling fans and, more particularly, to a kit for decorating ceiling fan blades.

2. Description of the Related Art

Ceiling fans have become very popular for providing quiet air circulation in both residential and commercial structures. The fans provide an energy efficient means of cooling a room in the summer and mixing heated air during the winter. However, an inherent problem associated with ceiling fans is that the blades thereof collect dust, dirt, grime, and allergens. When stationary, the blades of the fan provide a surface on which dust and other particles and vapors settle. In addition, as heated air rises, such air transports dust, lint, oily vapors, and other particles. Upon actuation of the ceiling fan, the blades travel through the air containing this mixture, thereby causing a layer of the mixture to further accumulate on the surfaces of the fan blades. In addition, as the fan blades rotate, they disperse the accumulated dust, allergens, and other particles about the room, thereby substantially reducing the air quality in the surrounding area, and in turn causing breathing difficulties and eye, nose, and throat irritations.

Another problem associated with ceiling fans is the difficulty in cleaning the blades on a regular basis. In most instances, a ladder or stool is required to reach the upper surfaces of the blades in order to properly clean such surfaces. This is a cumbersome task and can be hazardous given that the person must balance themselves on the ladder or stool and the blades are susceptible to rotate during the cleaning process.

Still another problem associated with ceiling fans is once the blades become worn, blades generally cannot be simply replaced. Thus a new ceiling fan must be purchased which may necessitate additional costs which include but are not limited to installation.

Yet another problem associated with ceiling fans is the lack of color continuity concerning the ceiling fan and a redecorated or painted room. In order to match the new decor, either a new ceiling fan or new blades must be purchased. Alternatively, the blades must be disassembled from the fan and painted separately.

Accordingly, a need has arisen for a commercially available kit which includes a decorative means for shielding ceiling fan blades against dust, lint, allergens, oily vapors, and debris in a manner which is quick, easy, and efficient. The development of the kit for decorating ceiling fan blades fulfills this need.

A search of the prior art did not disclose any patents that read directly on the claims of the instant invention; however, the following references were considered related.

The following patents disclose various ceiling fan blade covers and decorative fan blades:

U.S. Pat. No. 6,079,947, issued in the name of Gabriel et al.;

U.S. Pat. No. 6,082,868, issued in the name of Carpenter;

U.S. Pat. No. 5,470,205, issued in the name of Conklin, Jr.;

U.S. Pat. No. 5,564,900, issued in the name of McAuley;

U.S. Pat. No. 5,591,006, issued in the name of DeMeo et al.;

U.S. Pat. No. 5,591,005, issued in the name of McCready;

U.S. Pat. No. 6,619,920 B1, issued in the name of Cannon;

U.S. Pat. No. 5,281,093, issued in the name of Sedlak et al.;

U.S. Pat. No. 4,832,572, issued in the name of Prucha et al.;

U.S. Pat. No. 5,947,686, issued in the name of Keyes;

U.S. Pat. No. 7,056,090 B1, issued in the name of Stengel;

U.S. Pat. No. 6,015,261, issued in the name of Barone; and

U.S. Pat. No. 5,516,264, issued in the name of Anetrini.

U.S. Pat. No. 6,971,854 B2, issued in the name of Krakowski discloses a mobile kit for a ceiling fan.

Consequently, a need has been felt for a commercially available kit which includes a decorative means for shielding ceiling fan blades against dust, lint, allergens, oily vapors, and debris in a manner which is quick, easy, and efficient.

SUMMARY OF THE INVENTION

Therefore, it is an object of the present invention to provide a decorative fan blade cover.

It is another object of the present invention to provide a decorative fan blade cover which readily conforms to the shape of a ceiling fan blade.

It is another object of the present invention to provide a fan blade cover fabricated of a highly elastic, flexible material.

It is another object of the present invention to provide a fan blade cover fabricated of a lightweight, flexible disposable material.

It is another object of the present invention to provide a washable and/or disposable fan blade cover.

It is another object of the present invention to provide a closure mechanism for tightly closing a mouth portion of the cover upon a suitable portion of the arm of the blade.

It is another object of the present invention to provide a ceiling fan blade cover embellished with ornamentation or a decorative image.

It is still another object of the present invention to provide a ceiling fan blade cover adapted to have a desired decorative theme removably applied thereto.

It is another object of the present invention to provide a fan blade cover in the form of a slip cover.

It is yet another object of the present invention to provide a plurality of kits for decorating ceiling fan blades.

Briefly described according to one embodiment of the present invention, a decorative fan blade cover is disclosed. The decorative fan blade cover comprises a tubular sleeve fabricated of a flexible, disposable material such as plastic or a plastic polymer. The tubular sleeves may also be fabricated of a highly elastic, flexible, washable fabric material adapted to readily conform to the shape of a ceiling fan blade. The cover is configured to fit various sizes and contours of fan blades. The fitted tubular sleeve has an openable and closable mouth for receiving the fan blade portion, and a closed end. The mouth of the fitted tubular sleeve is provided with a closure mechanism for tightly closing the mouth around an arm of the ceiling fan blade.

The display side of tubular sleeve is embellished with ornamentation or a decorative image. The decorative image is envisioned to include a pattern, design, print, symbol, indicia, and a color or series of colors. The display side is directed downwardly when covering a fan blade.

According to another embodiment, tubular sleeves may also be provided and suitably adapted to have a desired decorative theme removably adhered thereto. In reference to this embodiment, the decorative theme is provided in the form of at least one theme element, or a combination of theme elements comprised of patterns, images, designs, prints, symbols, and/or indicia supplied on a substrate adapted for removable attachment to tubular sleeve.

In order to accommodate a theme exemplified by the interior decoration of a room into which the ceiling fan is located, and to accommodate refashioned themes as decorative interests change or evolve, a kit for decorating ceiling fan blades is disclosed. The kit may also be utilized for decorating ceiling fan blades according to an individual's own particular interest or desires, irrespective of the theme corresponding to the interior decoration of the room into which the ceiling fan is located. The kit comprises a package suitably adapted for housing a plurality of tubular sleeves embellished with a decorative theme, a light source, and an instruction leaflet. Kit may also be manufactured so as to comprise a package suitably adapted for housing plurality of tubular sleeves, at least one theme element or a combination of theme elements each element being supplied on a substrate for releasable attachment to the plurality of tubular sleeves, a light source, and an instruction leaflet.

According to another embodiment, the tubular sleeves may also be provided in the form of slip covers adapted for installation on ceiling fan blades. The slip covers each include a pocket for housing a desired theme element.

According to still another embodiment, an overlay is disclosed. The overlay is adapted for removable attachment to the upward side of fan blade. The overlay is adapted to attract, collect, and accumulate dust, lint, dirt, grime, allergens and other airborne particles in an inconspicuous manner.

The use of the present invention provides a decorative means for shielding ceiling fan blades against dust, lint, allergens, oily vapors, and debris in a manner which is quick, easy, and efficient.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

DESCRIPTION OF THE PREFERRED EMBODIMENT

1. Detailed Description of the Figures

Figure 1:
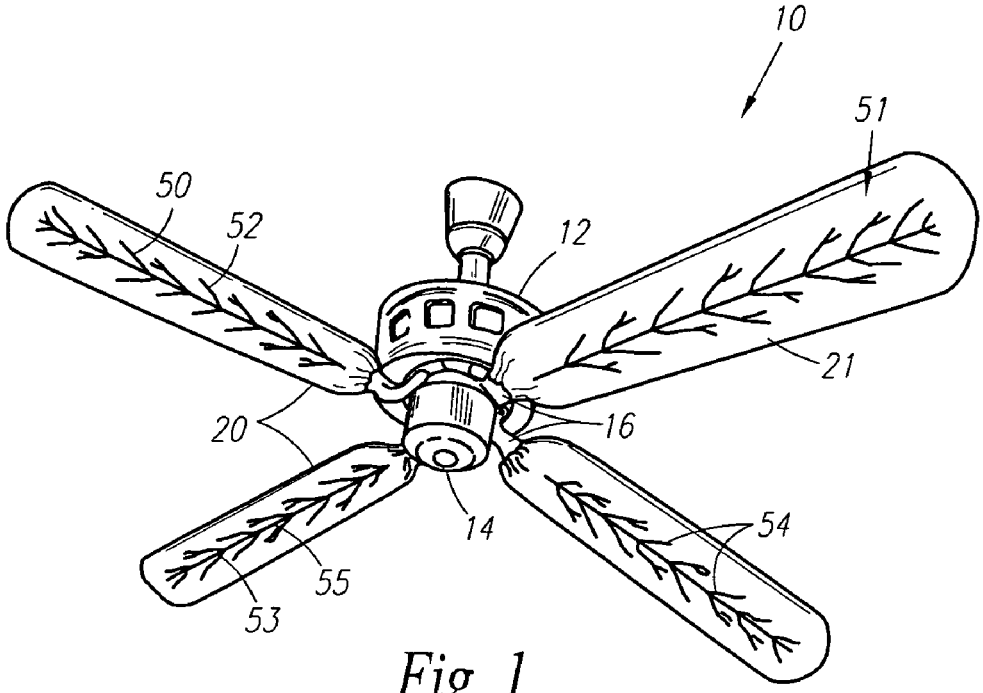
FIG. 1 is a bottom perspective view of a ceiling fan having decorative fan blade covers, according to the preferred embodiment of the present invention.
Figure 2:
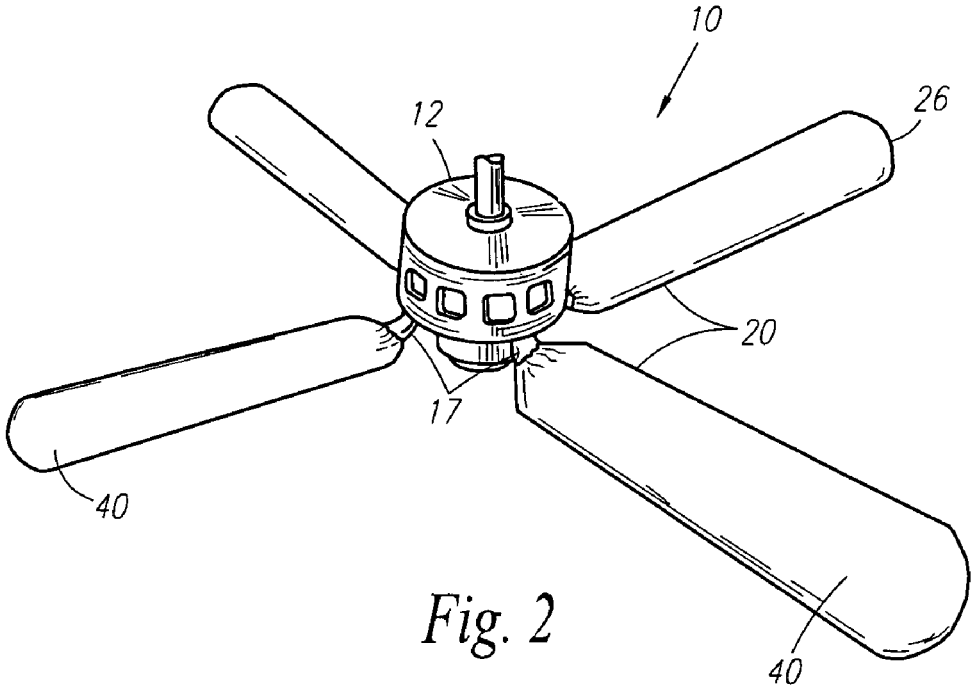
FIG. 2 is a top perspective view of a ceiling fan having decorative fan blade covers, according to the preferred embodiment of the present invention.
Figure 3:
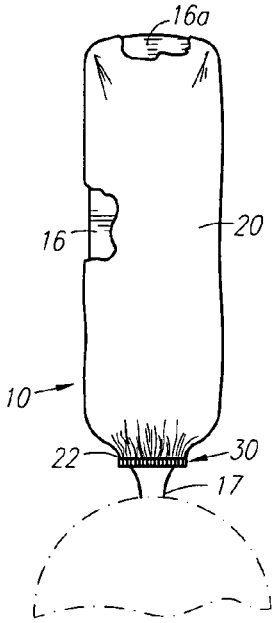
FIG. 3 is a partially broken away top plan view of the decorative fan blade cover illustrated in FIG. 2, shown installed on a ceiling fan blade.

Referring now to FIGS. 1-3, a decorative fan blade cover 10, is shown, according to the present invention, installed on a conventional ceiling fan 12. The decorative fan blade cover 10 comprises a highly elastic, flexible fitted tubular sleeve 20 adapted to readily conform to the shape of a ceiling fan blade 16. Thus, the cover 10 is adapted to fit various sizes and contours of fan blades 16. The fitted tubular sleeve 20 has an openable and closable mouth 22 adapted for receiving the fan blade 16 portion, and a closed end 26 associated with an end 16*a* of the fan blade 16 being spaced distally from the rotary fan shaft 14. The mouth 22 of the fitted tubular sleeve 20 is provided with a closure mechanism 30 for tightly closing the mouth 22 around an arm 17 of the ceiling fan blade 16.

The tubular sleeve 20 is fabricated of a highly elastic, flexible fabric material 40 adapted for receiving ornamentation 50. The highly elastic, flexible fabric material 40 is selected from the group which includes but is not limited to a long chain synthetic polymer having at least 85% segmented polyurethane, such as SPANDEX, textile composites which include 80% cotton/20% spandex, 70% wool/30% spandex, 80% cotton/15% nylon/5% spandex, 8% LYCRA®/92% microfiber at 60 denier, and the like. The fabrication material 40 utilized to construct tubular sleeve 20 allows for sleeve 20 to be washable and/or disposable. The tubular sleeves 20 are available in a color or series of colors.

Figure 4:
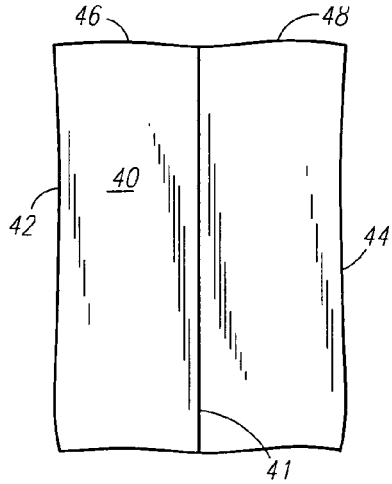
FIG. 4 is a plan view of a piece of fabrication material utilized to fabricate a decorative fan blade cover constructed according to one embodiment of the present invention.
Figure 5:
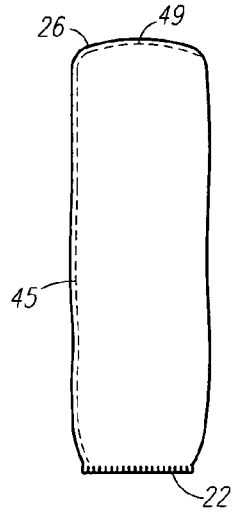
FIG. 5 is a side elevational view of the fabrication material utilized to fabricate a decorative fan blade cover, wherein segments of the fabrication material are shown sewn to form seams, according to one embodiment of the present invention.

Referring now to FIG. 4 and FIG. 5, the tubular sleeve 20 is formed into a tubular configuration by folding a flat, generally rectangular sheet of fabrication material 40 over itself along fold line 41 in a manner such that segment 42 engages segment 44, and segment 46 engages segment 48. Segments 42 and 44 are sewn together to form seam 45, and segments 46 and 48 are sewn together to form seam 49 in a manner so as to provide the closed end 26 portion and the openable and closable mouth 22 portion. Alternatively, tubular sleeve 20 may be fabricated in a seamless version commonly referred to as a tubular one-piece construction having an open end 22 opposing a closed end 26. In a relaxed configuration, the overall length of the tubular sleeve 20 is less than an overall length of the fan blade 16, and the width of the tubular sleeve 20 is significantly less than an overall width of the fan blade 16.

Figure 6:
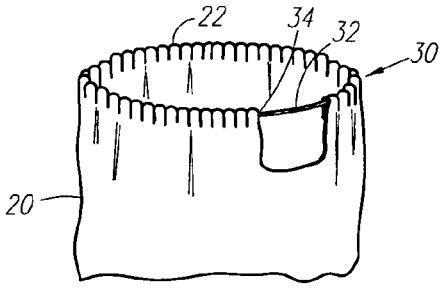
FIG. 6 is a partially broken away perspective view of a decorative fan blade cover illustrating the closure mechanism, according to the preferred embodiment of the present invention.

Referring now to FIG. 3 and FIG. 6, when the tubular sleeve 20 is slipped over a respective ceiling fan blade 16, the mouth 22 portion is closed upon a suitable portion of the arm 17 using the closure mechanism 30. The closure mechanism 30 is preferably via an elastic band 32 suitably disposed in an end seam loop 34 formed at mouth 22 portion.

Figure 7:
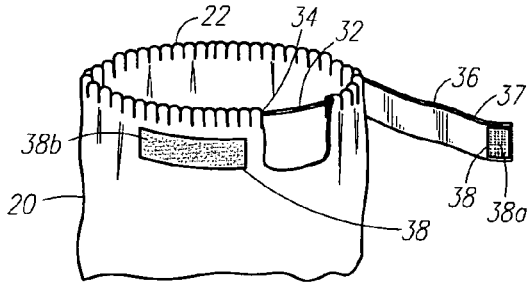
FIG. 7 is a partially broken away perspective view of a decorative fan blade cover illustrating the closure mechanism, according to an alternate embodiment of the present invention.

Alternatively, closure mechanism 30 may be in the form of a releasable fastener 36, as shown in FIG. 7. Releasable fastener 36 is envisioned to be in the form of a tab 37 attached to the outer surface of the tubular sleeve 20 adjacent the mouth 22, wherein tab 37 includes a hook portion 38*a* of a hook-and-loop fastener 38. A loop portion 38*b* of the hook-and-loop fastener 38 is attached to the outer surface of tubular sleeve 20, proximal to tab 37. The hook portion 38*a* and loop portion 38*b* are positioned about the mouth 22 so as to provide for a range of mouth 22 portion closure sections, thereby accommodating a broad range of cross-sections of conventional blade arms 17.

When stretched longitudinally and transversely, the tubular sleeve 20 tightly and conformingly grips against the outer surface of the fan blade 16 in a manner such that during operation, the tubular sleeve 20 remains fixed in the installed position, and is resistant to centrifugal and air forces encountered during ceiling fan 12 operation.

Referring now more particularly to FIG. 1, a lower side or display side 21 of the tubular sleeve 20 is embellished with ornamentation 50 in the form of a decorative theme 51 or image, such as holidays and symbols therefor, including Christmas, Thanksgiving, Fourth of July, Easter, New Years, Halloween, and the like, geographical locations, formations, and objects, such as plant and tree life 53, a lighthouse, a tropical scene, a snowy-winter scene, a rain forest, nautical or aquatic scenes which include aquatic life such as fish, whales, sharks, and dolphins, wild and exotic animals, domestic animals, such as images of one's pet(s), sports, including motor sports, football, baseball, basketball, soccer, tennis, golf, and sports symbols therefor, sports equipment, sports venues, and teams, prehistoric reptiles, cartoon characters, fairytale characters, outer space and objects representative thereof, such as celestial images, stars, moon, planets and the like, cultural images and symbols representative of particular cultures, such as Southwestern and tribal cultures, religious images and symbols representative of particular religions, and family photos.

The decorative theme 51 is disposed along the display side 21 of tubular sleeve 20. The display side 21 of tubular sleeve 20 is directed downwardly when covering a fan blade 16. User may select a decorative theme 51 in order to correspond with the decor of the room into which the ceiling fan 12 is located, or according to user's personal preference. The decorative image 51 provided in FIG. 1 illustrates plant life 53, shown herein as a leaf 54, complete with venation 55. Thus, once installed on a ceiling fan blade 16, the cover 10, according to this particular example and illustration only, is adapted to resemble or simulate an enlarged leaf 54.

Figure 8:
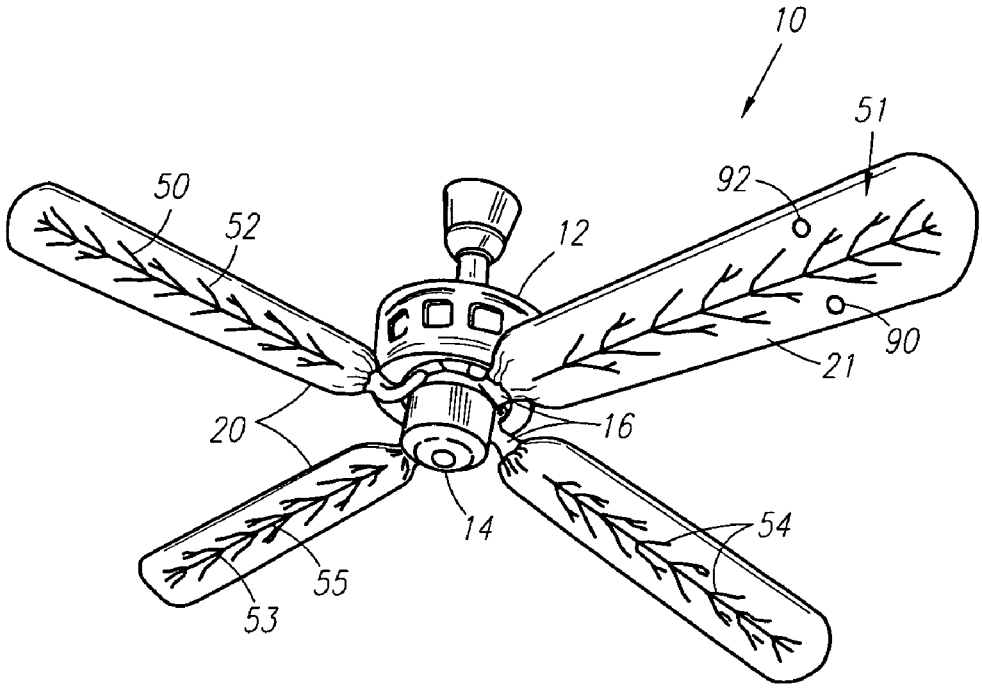
FIG. 8 is a bottom perspective view of a ceiling fan having decorative fan blade covers which include a light source.
Figure 9:
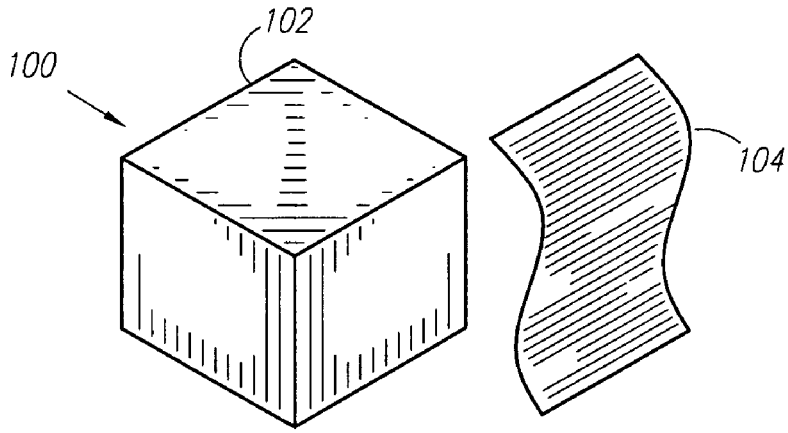
FIG. 9 is a side perspective view of a package for housing a kit, according to one embodiment of the present invention.

Referring now to FIG. 8 and FIG. 9, in order to accommodate a theme exemplified by the interior decoration of a room into which the ceiling fan 12 is located, and to accommodate refashioned themes as decorative interests change or evolve, a kit for decorating ceiling fan blades 100 is provided. The kit 100 may also be utilized for decorating ceiling fan blades 16 according to an individual's own particular interest or desires, irrespective of the theme corresponding to the interior decoration of the room into which the ceiling fan 12 is located.

The kit 100 comprises a plurality of tubular sleeves 20 each adapted to snugly cover a ceiling fan blade 16. Tubular sleeves 20 are preferably fabricated of a flexible disposable material such as plastic or a plastic polymer. The tubular sleeves 20 may also be fabricated of a highly elastic, flexible fabric material, thus allowing sleeves to be washable. It is envisioned that tubular sleeves 20 may also be constructed of paper material, although less durable than plastic or textile material.

The tubular sleeves 20 are each formed into a tubular configuration via pressure sealing or heat sealing methods, or according to other fabrication methods described earlier above concerning tubular sleeves 20 constructed of fabric or textile material(s).

The tubular sleeves 20 are available in a color or series of colors, including transparent or clear. The display side 21 of each of the tubular sleeves 20 is embellished with a decorative theme 51.

Figure 10:
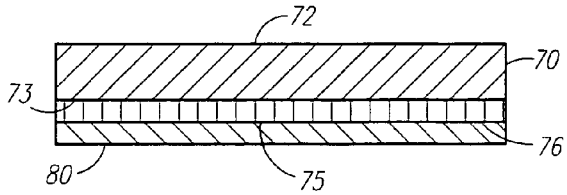
FIG. 10 is a cross-sectional view of a substrate.
Figure 11:
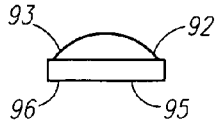
FIG. 11 is a side elevational view of a light source, shown herein as an LED.
Figure 12:
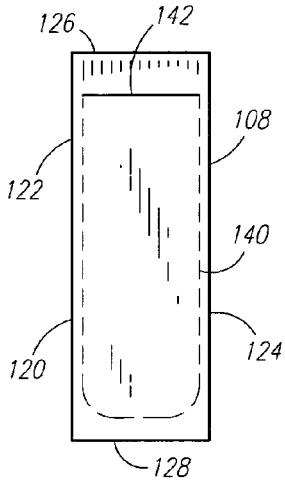
FIG. 12 is a top plan view of a slip cover.
Figure 13:
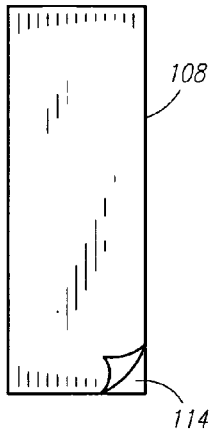
FIG. 13 is a bottom plan view of the slip cover of FIG. 12.
Figure 14:
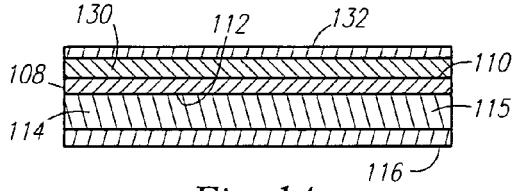
FIG. 14 is a cross-sectional view of the slip cover.
Figure 15:
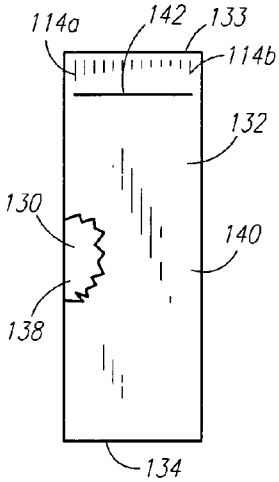
FIG. 15 is a top plan view of the slip cover illustrating a thin, transparent layer which forms a blade receiving pocket.

Referring now more specifically to FIGS. 9-11, according to another embodiment, tubular sleeves 20 may also be provided and suitably adapted to have a desired decorative theme 51 removably applied thereto. According to this embodiment, the decorative theme 51 is provided in the form of at least one theme element 52, or a combination of theme elements 52 comprised of patterns, images, designs, prints, symbols, and/or indicia supplied on a substrate 70. The kit 100 includes a plurality of substrates 70. Each substrate 70 is enveloped by a layer of pressure-sensitive adhesive 75 along the bottom side 73 thereof. The top side 72 or face of substrate 70 is decorated with the decorative theme 51. The pressure-sensitive adhesive 75 includes an adhesive coating 76 on its outer side being suitable to releasably adhere to the display side 21 of tubular sleeve 20. The adhesive coating 76 is defined of a binding composition being suitable to adhere substrate 70 to tubular sleeve 20 and to allow substrate 70 to be readily removed from sleeve 20 without causing damage thereto. Thus, the plurality of substrates 70 are adapted to be replaced and substituted with another selectively desired substrate 70 in order to accommodate user's varied interests and needs. The plurality of substrates 70 are adapted to allow user to customize user's fan blades 16 in unique ornamental styles.

A removable release liner 80 covers the outer side of the pressure-sensitive adhesive 75 in order to afford protection thereto until desired use, and to prevent adhesive 75 from binding to any surface prematurely. The removable release liner 80 is readily peelable from the pressure-sensitive adhesive 75 and does not remove the adhesive coating 76 therefrom. Once the release liner 80 is removed, the pressure-sensitive adhesive 75 is engaged against the display side 21 of each of the tubular sleeves 20 so that a selected theme element 52 is viewable from the lower side or display side 21 of the tubular sleeve 20.

According to another embodiment, the decorative theme 51 is provided in the form of at least one theme element 52, or a combination of theme elements 52 comprised of patterns, images, designs, prints, symbols, and/or indicia adapted for attachment via a suitable attachment means to the display side 21 of each of the tubular sleeves 20.

According to still another embodiment, the at least one theme element 52 comprises an air freshener 210 envisioned to be available in a variety of forms including but not limited to stick or thin plate, housed fragrance, and the like.

A light source 90 is provided for releasable adherence to the display side 21 of tubular sleeve 20. The light source 90 is preferably high-intensity lights or light emitting diodes (LEDs) 92. The LEDs 92 have a transparent or translucent plastic lens body 93 extending upward from a base 95 having a flat lower surface 96. The lens body 93 is manufactured so as to be available in a variety of shapes, such as circular, square, rectangular, triangular, pentagonal, hexagonal, octagonal, trapezoidal, rhomboidal, and elliptical.

Kit 100 is manufactured so as to be commercially available, the commercially available kit 100 comprises a plurality of tubular sleeves 20 embellished with a decorative theme 51, a package 102 suitably adapted for housing the plurality of tubular sleeves 20, a light source 90, and an instruction leaflet 104 which provides detailed instructions for installing tubular sleeves 20 to ceiling fan blades 16. Kit 100 may also be manufactured for commercial availability and comprise a plurality of tubular sleeves 20, a package 102 suitably adapted for housing the plurality of tubular sleeves 20, at least one theme element 52 or a combination of theme elements 52 each element 52 being supplied on a substrate 70, a light source 90, and an instruction leaflet 104 which provides detailed instructions for removably applying a desired decorative theme 51 to tubular sleeves 20 and for installing tubular sleeves 20 to ceiling fan blades 16.

Referring now to FIGS. 12-17, according to another embodiment, the tubular sleeves 20 may also be provided as slip covers 108, each being formed of an elongated, thin, flexible material having a front surface 110 and a rear surface 112. The rear surface 112 has a pressure-sensitive adhesive 114 mounted thereon. The pressure-sensitive adhesive 114 is comprised of an adhesive coating 115 suitably tacky so as to provide a surface on which dust, lint, dirt, grime, allergens and other airborne particles are attracted, collected, and accumulated. A release liner 116 is applied over the pressure-sensitive adhesive 114. The release liner 116 is readily peelable from the pressure-sensitive adhesive 114 and does not remove the adhesive coating 115 therefrom.

The elongated, thin, flexible material defines a generally rectangular configuration having a length and width measurably larger than the ceiling fan blade 16. The periphery 120 of elongated, thin, flexible material is defined of a first side edge 122, a second side edge 124, a proximal edge 126, and a distal edge 128. Thin, flexible material is preferably fabricated of a paper material, but may also be fabricated of other fabrication materials such as plastic. A thin, flexible membrane 130 is attached atop elongated, thin, flexible material. Thin, flexible membrane 130 substantially corresponds to a shape of elongated, thin, flexible material so as to cover an entire upper surface thereof. A thin, transparent layer 132 is laminated atop thin, flexible membrane 130 along a periphery 138 thereof in a manner so as to form a blade receiving pocket 140. Thin, transparent layer 132 substantially corresponds to a shape of thin, flexible membrane 130 and elongated, thin, flexible material. Thin, transparent layer 132 includes an anterior edge 133 opposing a posterior edge 134. A horizontally extending slit 142 is provided below the anterior edge 133 of thin, transparent layer 132, slit 142 providing direct passage into the blade receiving pocket 140. Slit 142 defines a length allowing an end 16*a* of fan blade 16 to be inserted therethrough, thereby allowing fan blade 16 to be slidably inserted and housed inside blade receiving pocket 140. A lightweight, thin, semi-rigid insert 200 is inserted through slit 142 of thin, transparent layer 132 and positioned between the downward side of fan blade 16 and the thin, transparent layer 132 so that insert 200 is directed downwardly. The insert 200 defines a generally rectangular configuration being sizably adapted to fit snugly inside blade receiving pocket 140. A desired theme element 52, such as an artificial leaf 54*a*, is inserted through slit 142 of thin, transparent layer 132, and positioned between the thin, transparent layer 132 and the insert 200. The at least one theme element 52 or a combination of theme elements 52 is thus housed within said blade receiving pocket 140 and directed downwardly. The at least one theme element 52 or a combination of theme elements 52 may be slidably inserted into blade receiving pocket 140 at a desired position therein. Being transparent, the thin, transparent layer 132 allows for the selected theme element(s) 52 to be displayed in clear view by user and other observers. The blade receiving pocket 140 allows for any number of desired decorative themes 51 to be displayed therein and viewed clearly. The insert 200 is adapted to prevent a selected theme element 52 from crimping at the outer end 16*a* of fan blade 16 as centrifugal forces are generated during ceiling fan 12 operation.

It is envisioned that a theme element 52 or a combination of theme elements 52 can be suitably attached to the insert 200 prior to insertion of insert 200 through slit 142 and into blade receiving pocket 140. After attachment of theme element(s) 52 to insert 200, the insert 200 is inserted inside blade receiving pocket 140 in a manner such that the theme element(s) 52 are directed downwardly so as to be visible to an observer. Additionally, an air freshener 210, sizably adapted for containment within the blade receiving pocket 140, may be suitably attached to insert 200 prior to insertion of insert 200 through slit 142 and into blade receiving pocket 140. Alternatively, air freshener 210 may be inserted through slit 142 of thin, transparent layer 132, and positioned between the thin, transparent layer 132 and the insert 200, so that the air freshener 210 is directed downwardly, and air freshener 210 is slidably inserted into blade receiving pocket 140 at a desired position. Where an air freshener 210 is utilized as the theme element 52, the thin, transparent layer 132 comprises a plurality of apertures 214 through which a fragrance of air freshener 210 is permitted to be emitted and diffused about the room into which the ceiling fan 12 is located (apertures 214 illustrated in FIG. 16*a*).

Figure 16:
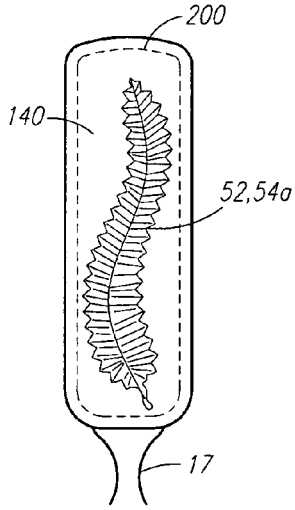
FIG. 16 is a bottom perspective view of the slip cover shown installed on a fan blade.
Figure 16A:
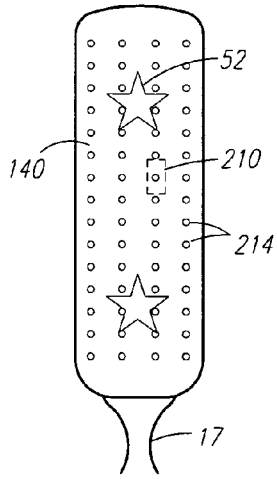
FIG. 16*a* is bottom perspective view of the slip cover shown installed on a fan blade illustrating apertures defined through the thin, transparent layer.
Figure 17:
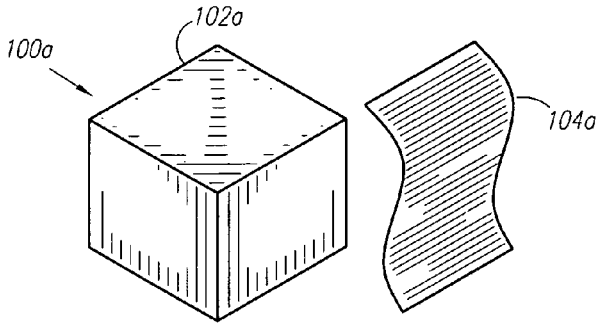
FIG. 17 is a side perspective view of a package for housing a kit, according to one embodiment of the present invention.
Figure 18:
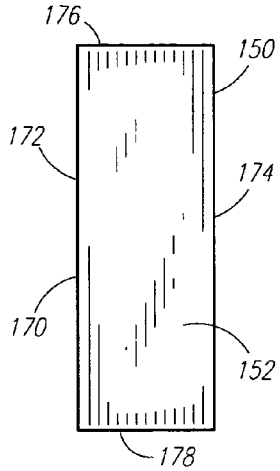
FIG. 18 is a top plan view of an overlay, according to another embodiment of the present invention.
Figure 19:
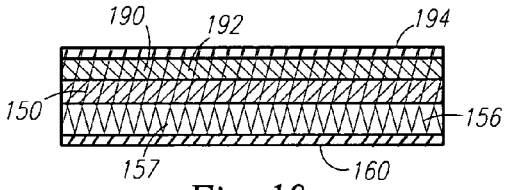
FIG. 19 is a cross-sectional view of the overlay of FIG. 18.
Figure 20:
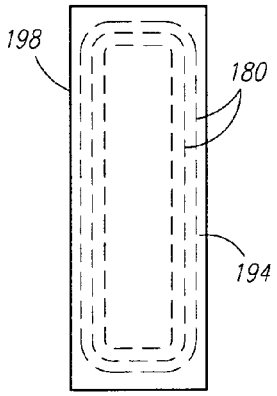
FIG. 20 is a top plan view of a release liner at the front surface of the overlay.
Figure 21:
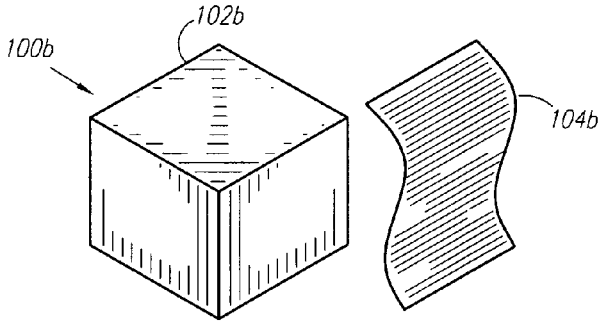
FIG. 21 is a side perspective view of a package for housing a kit, according to one embodiment of the present invention.

In order to secure slip cover 108 to a fan blade 16 so that it remains fixed in the installed position, and resistant to centrifugal and air forces encountered during ceiling fan 12 operation, the release liner 116 is peeled from the pressure-sensitive adhesive 114 and upper corners 114*a*, 114*b* of pressure-sensitive adhesive 114 are overlapped atop the upward side of fan blade 16 below the arm 17 thereof in a manner such that the adhesive coating 115 of pressure-sensitive adhesive 114 binds to the upward side of fan blade 16. As shown in FIG. 16, the corners 114*a* and 114*b* are reverse folded so as to reside in a fixed overlapped position atop the upward side of fan blade 16 and snugly against the lower end of arm 17, thereby securing slip cover 108 to a fan blade 16.

Another kit 100*a* embodiment is manufactured so as to be commercially available, the commercially available kit 100*a* comprises a plurality of slip covers 108, a package 102*a* suitably adapted for housing the plurality of slip covers 108, a lightweight, thin, semi-rigid insert 200, at least one theme element or a combination of theme elements 52, a light source 90, and an instruction leaflet 104*a* providing instructions for installing theme element(s) 52 inside the blade receiving pocket 140 of each of the slip covers 108 and for installing slip covers 108 to ceiling fan blades 16.

Finally, referring to FIGS. 18-21, according to still another embodiment, an overlay 150 is provided. The overlay 150 comprises an elongated, thin flexible material having a generally rectangular configuration having a length and width measurably larger than the ceiling fan blade 16. Elongated, thin, flexible material has a front surface 152 and a rear surface 154. The front surface 152 has a pressure-sensitive adhesive 190 mounted thereon. The pressure-sensitive adhesive 190 is comprised of an adhesive coating 192 suitably tacky so as to provide a surface on which dust, lint, dirt, grime, allergens and other airborne particles are attracted, collected, and accumulated. A release liner 194 is applied over the pressure-sensitive adhesive 190. The release liner 194 is readily peelable from the pressure-sensitive adhesive 190 and does not remove the adhesive coating 192 therefrom.

The rear surface 154 has a pressure-sensitive adhesive 156 mounted thereon. The pressure-sensitive adhesive 156 is comprised of an adhesive coating 157 suitably tacky so as to releasably secure overlay 150 to the upward side of fan blade 16. A release liner 160 is applied over the pressure-sensitive adhesive 156. The release liner 160 is readily peelable from the pressure-sensitive adhesive 156 and does not remove the adhesive coating 157 therefrom. The periphery 170 of elongated, thin, flexible material is defined of a first side edge 172, a second side edge 174, a proximal edge 176, and a distal edge 178. Elongated, thin, flexible material is preferably fabricated of a paper material, but may also be fabricated of other fabrication materials such as plastic and a plastic polymer.

Release liner 194 at front surface 152 of overlay 150 is perforated at regular intervals, along perforations 180. Perforations 180 extend along an entire first inner edge adjacent the periphery 198 of liner 194 and an entire second inner edge aligned internal to first inner edge such that perforations 180 at first inner edge encircle perforations provided at second inner edge. Additional perforations 180 may be provided in the manner described above so as to include perforations 180 at a third inner edge, a fourth inner edge, and the like. Perforations 180 provide user with a visual guide for cuffing-away a desired margin of the periphery 170 of overlay 150 in order to custom fit overlay 150 to the dimensions of a selected fan blade 16. Perforations 180 may include any combination of short and long slits or scores separated by short and long areas of liner 194 material. Scores are meant to include indentations in the liner 194 material that do not extend all the way through the overlay 150 material.

After trimming a desired margin of the periphery 170 of overlay 150, if so required, the release liner 160 at rear surface of 154 of overlay 150 is removed from the pressure-sensitive adhesive 156. Pressure-sensitive adhesive 156 is engaged against the upward side of fan blade 16 in an overlaid, matching or shape-correspondent manner, thereby allowing the adhesive coating 157 of pressure-sensitive adhesive 156 to releasably bind to the upward side of fan blade 16. The release liner 194 at front surface 152 of overlay 150 is then removed. In this particular embodiment, overlay 150 is adapted to attract, collect, and accumulate dust, lint, dirt, grime, allergens and other airborne particles in an inconspicuous manner.

Thus, according to another embodiment, a kit 100*b* is disclosed comprising a plurality of overlays 150, a package 102*b* suitably adapted for housing the plurality of overlays 150, and an instruction leaflet 104*b* providing instructions for releasably attaching the plurality of overlays 150 to ceiling fan blades 16.

The use of the present invention provides a decorative means for shielding ceiling fan blades 16 against dust, lint, allergens, oily vapors, and debris in a manner which is quick, easy, and efficient.

2. Operation of the Preferred Embodiment

To use the present invention, user inserts the outer end 16*a* of fan blade 16 through the closable mouth 22 of tubular sleeve 20. User then closes the mouth 22 upon a suitable portion of the fan blade arm 17 using the closure mechanism 30.

The use of the present invention provides a decorative means for shielding ceiling fan blades 16 against dust, lint, allergens, oily vapors, and debris in a manner which is quick, easy, and efficient.

Therefore, the foregoing description is included to illustrate the operation of the preferred embodiment and is not meant to limit the scope of the invention. As one can envision, an individual skilled in the relevant art, in conjunction with the present teachings, would be capable of incorporating many minor modifications that are anticipated within this disclosure. The foregoing descriptions of specific embodiments of the present invention have been presented for purposes of illustration and description. They are not intended to be exhaustive or to limit the invention to the precise forms disclosed, and obviously many modifications and variations are possible in light of the above teaching. The embodiments were chosen and described in order to best explain the principles of the invention and its practical application, to thereby enable others skilled in the art to best utilize the invention and various embodiments with various modifications as are suited to the particular use contemplated. It is intended that the scope of the invention be defined by the Claims appended hereto and their equivalents. Therefore, the scope of the invention is to be broadly limited only by the following Claims.

What is claimed is:

1. A kit for decorating ceiling fan blades comprising:

a plurality of slip covers, each said plurality of slip covers being installed on a ceiling fan blade, said plurality of slip covers each being formed of an elongated, thin, flexible material having a front surface and a rear surface, said rear surface has a pressure-sensitive adhesive mounted thereon, said elongated, thin, flexible material defines a generally rectangular configuration having a length and width measurably larger than the ceiling fan blade, said elongated, thin, flexible material has a periphery defined of a first side edge, a second side edge, a proximal edge, and a distal edge, wherein said elongated, thin, flexible material has a thin, flexible membrane attached to the front surface thereof, said thin, flexible membrane substantially corresponds to a shape of said elongated, thin, flexible material so as to cover an entire upper surface thereof, said thin, flexible membrane has a thin, transparent layer laminated to a top side thereof along a periphery of said thin, flexible membrane in a manner so as to form a blade receiving pocket, said thin, transparent layer substantially corresponds to a shape of said thin, flexible membrane and said elongated, thin, flexible material, said thin, transparent layer includes an anterior edge opposing a posterior edge, said anterior edge defining a horizontally extending slit positioned therebelow, said slit providing direct passage into said blade receiving pocket, said slit defines a length allowing a distal end of the fan blade to be inserted therethrough, the fan blade is slidably inserted and housed inside said blade receiving pocket, wherein said pressure-sensitive adhesive is comprised of an adhesive coating suitably tacky so as to provide a surface on which dust, lint, dirt, grime, allergens and other airborne particles are attracted, collected, and accumulated, said pressure-sensitive has a release liner applied thereover, said release liner is readily peelable from said pressure-sensitive adhesive;

at least one theme element or a combination of theme elements adapted for insertion inside said plurality of slip covers;

an instruction leaflet;

an insert; and a package suitably adapted for housing said plurality of slip covers, said at least one theme element or a combination of theme elements, said insert, and said instruction leaflet.

2. The kit of claim 1, wherein said insert defines a lightweight, thin, semi-rigid, generally rectangular configuration, said insert is inserted through said slit of said thin, transparent layer and is positioned between said thin, flexible membrane and said thin, transparent layer so that said insert is oriented downwardly, said insert is sizably adapted to fit snugly inside said blade receiving pocket.

3. The kit of claim 1, wherein said at least one theme element or a combination of theme elements is inserted through said slit of said thin, transparent layer, and said at least one theme element or a combination of theme elements is positioned between the thin, transparent layer and said insert, thereby housing said at least one theme element or a combination of theme elements within said blade receiving pocket, said at least one theme element or a combination of theme elements is oriented downwardly so as to be viewable by an observer.

4. The kit of claim 3, wherein said at least one theme element or a combination of theme elements is an air freshener.

5. The kit of claim 1, wherein said at least one theme element or a combination of theme elements is suitably attached to said insert, wherein said insert with attached said at least one theme element or a combination of theme elements is positioned between said thin, transparent layer and said thin, flexible membrane, said thin, flexible membrane being attached to the front surface of said elongated, thin, flexible material, and wherein said at least one theme element or a combination of theme elements is oriented downwardly so as to be viewable by an observer.

6. The kit of claim 1, wherein said thin, transparent layer comprises a plurality of apertures defined therethrough.

7. The kit of claim 1, wherein said release liner is peeled from said pressure-sensitive adhesive, said pressure-sensitive adhesive having upper corners which are overlapped in a reverse-folded manner atop an upward side of the fan blade and snugly against a lower end of an arm of the fan blade in a manner such that said adhesive coating of said pressure-sensitive adhesive binds to the upward side of the fan blade, thereby securing said slip cover to the fan blade so that said slip cover remains fixed in an installed position, and resistant to centrifugal and air forces encountered during a ceiling fan operation.

8. The kit of claim 1, wherein said thin, flexible material is fabricated of a paper material.

* * * * *